US010851748B2

(12) United States Patent
Gerundt et al.

(10) Patent No.: US 10,851,748 B2
(45) Date of Patent: Dec. 1, 2020

(54) FUEL DISTRIBUTOR FOR INTERNAL COMBUSTION ENGINES

(71) Applicant: Robert Bosch GmbH, Stuttgart (DE)

(72) Inventors: Oliver Gerundt, Friolzheim (DE); Peter Schenk, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/394,188

(22) Filed: Apr. 25, 2019

(65) Prior Publication Data

US 2019/0353126 A1 Nov. 21, 2019

(30) Foreign Application Priority Data

May 17, 2018 (DE) ..... 10 2018 207 760

(51) Int. Cl.

| | |
|---|---|
| ***F02M 55/04*** | (2006.01) |
| ***F02M 63/02*** | (2006.01) |
| ***F02M 55/02*** | (2006.01) |
| *F02D 41/38* | (2006.01) |

(52) U.S. Cl.

CPC ..... *F02M 55/04* (2013.01); *F02M 55/025* (2013.01); *F02M 63/0225* (2013.01); *F02M 63/0275* (2013.01); *F02D 2041/389* (2013.01); *F02M 2200/315* (2013.01); *F02M 2200/8053* (2013.01)

(58) Field of Classification Search

CPC ..... F02D 2041/389; F02M 55/025; F02M 55/04; F02M 63/0225; F02M 63/0275; F02M 69/465; F02M 2200/315; F02M 2200/8053

USPC ..... 123/456, 468

See application file for complete search history.

(56) References Cited

U.S. PATENT DOCUMENTS

| | | | | |
|---|---|---|---|---|
| 7,146,700 | B1 * | 12/2006 | Darrah | B21D 26/033 29/419.2 |
| 7,520,268 | B1 * | 4/2009 | Sims, Jr. | F02M 55/025 123/447 |
| 2003/0084879 | A1 * | 5/2003 | Treusch | F02M 69/465 123/456 |
| 2005/0178363 | A1 * | 8/2005 | Bruehmann | F02M 55/005 123/467 |
| 2009/0223486 | A1 * | 9/2009 | Weizenauer | F02M 55/04 123/447 |

(Continued)

FOREIGN PATENT DOCUMENTS

DE 102014205179 A1 9/2015

*Primary Examiner* — Erick R Solis

(74) *Attorney, Agent, or Firm* — Norton Rose Fulbright US LLP; Gerard Messina

(57) ABSTRACT

A fuel distributor, in particular a fuel distribution rail for mixture-compressing, spark-ignited internal combustion engines, includes a base body at which at least one high-pressure input and multiple high-pressure outputs are provided and at least one insert element which is situated in the base body, the insert element separating a distribution area which connects the high-pressure outputs to one another at least essentially from a damping area. The insert element is configured at least essentially as a reshaped insert element. The insert element forms a divider which separates the distribution area at least essentially from the damping area. Furthermore, a fuel injection system including such a fuel distributor is provided.

11 Claims, 2 Drawing Sheets

(56) References Cited

U.S. PATENT DOCUMENTS

| | | | | |
|---|---|---|---|---|
| 2011/0057017 | A1* | 3/2011 | Zdroik | F02M 55/025 228/155 |
| 2014/0261330 | A1* | 9/2014 | Doherty | F02M 63/0275 123/456 |
| 2015/0167612 | A1* | 6/2015 | Durst | F16L 55/04 123/456 |
| 2017/0234282 | A1* | 8/2017 | Wang | F02M 55/025 123/294 |
| 2019/0383237 | A1* | 12/2019 | Weber | F02M 25/0228 |

* cited by examiner

FUEL DISTRIBUTOR FOR INTERNAL COMBUSTION ENGINES

RELATED APPLICATION INFORMATION

The present application claims priority to and the benefit of German patent application no. 10 2018 207 760.6, which was filed in Germany on May 17, 2018, the disclosure of which is incorporated herein by reference.

FIELD OF THE INVENTION

The present invention relates to a fuel distributor, in particular a fuel distribution rail for mixture-compressing, spark-ignited internal combustion engines, as well as a fuel injection system including such a fuel distributor. The present invention specifically relates to the field of fuel injection systems of motor vehicles in which fuel is injected directly into the combustion chambers of an internal combustion engine.

BACKGROUND INFORMATION

A fuel distribution rail for an internal combustion engine is discussed in DE 10 2014 205 179 A1. The fuel distribution rail has an elongated housing including a hollow space, a fuel inflow into the hollow space, and at least two fuel outflows out of the hollow space for each of the fuel injectors. In the hollow space, a body is situated which includes a groove which connects the two fuel outflows to one another and a groove which radially surrounds the body in the area of the fuel inflow. The body having the two grooves is used as an insert using which a direct inflow of the fuel from a pump to the injectors is ensured, this body potentially having an inside volume which is used for damping, but is not located in the direct fuel flow.

The fuel distribution rail from DE 10 2014 205 179 A1 may have the disadvantage that the manufacturing process of the insert is complex, since it is configured as a thick-walled tube having grooves.

SUMMARY OF THE INVENTION

The fuel distributor according to the present invention having the features described herein and the fuel injection system according to the present invention having the features described herein have the advantage that an improved configuration and functionality are possible. In particular, a cost-effective and/or easily manufacturable option may be implemented in order to provide an improved injection in combination with good damping behavior.

With the aid of the measures described herein, advantageous refinements of the fuel distributor indicated herein and of the fuel injection system indicated herein are possible.

The provided fuel distributor is suitable in particular for injecting a mixture, where the mixture composition is supposed to vary during operation. In particular, a direct water injection may be implemented in which water is injected in an emulsion together with at least one type of fuel, in particular gasoline, into the combustion chambers of an internal combustion engine. In this case, the water is supplied to the fuel upstream from or in a high-pressure pump and is conveyed together with the fuel to the high-pressure injectors via the fuel distributor.

The composition of the mixture, in particular of the emulsion, may vary during operation. For example, it is possible that the addition of water is necessary or desirable only in a certain area of the characteristic map. For example, it is possible that water or a larger water content may be desirable at a high rotational speed and/or at a high load. When this area of the characteristic map is left, for example in the case of a coasting cutoff, it is advantageous for the injected water content to be able to be rapidly reduced and, in particular, to rapidly go back toward zero. For this purpose, a short delay period is necessary between the addition of the water upstream from or in the high-pressure pump and the injection of same via the high-pressure injectors. In principle, the volume of the fuel distributor has an increasing effect on this delay period. By subdividing the interior of the base body into a distribution area and a damping area as well as, potentially, also an inflow area, it is possible, however, to shorten the delay period, while maintaining the damping, in particular the damping of the pressure pulsations. The insert element may be used to keep the hydraulic volume between the high-pressure input and the two or more high-pressure outputs small, while implementing a larger hydraulic damping volume.

The insert element is advantageously configured as a reshaped insert element, the insert element may be shaped from a sheet metal, thus resulting in low manufacturing costs. Here, a simple and cost-effective adaptation of a present high-pressure hydraulic system is possible with regard to implementing a direct water injection.

With the aid of the refinement according as described herein, a subdivision of the interior may advantageously take place, an advantageous geometric configuration of the distribution area being achieved. Specifically in a combination with the refinement as described herein, advantageous flow conditions may thus be achieved in the case of a small cross section and thus volume of the distribution area.

One advantageous geometry of the distribution area may be achieved in particular with the aid of a refinement as described herein. Here, the geometry of the distribution area may be optimized to such an extent that a short delay period results at which the emulsion is injected. Therefore, when the composition changes, in particular in the case of a change in the water content, it is possible to respond to the changed requirements with a short delay period.

With the aid of one refinement as described herein, an insert element which is at least essentially circumferentially closed may be advantageously shaped. In this way, an advantageous separation of the damping area from the distribution area is possible. A high-pressure input may then be located, for example, on a side of the base body which faces away from the high-pressure outputs. In order to enable the emulsion inflow from the high-pressure input into the distribution area, one refinement according to Claim 6 may be advantageously implemented. This also results in an advantageous geometry for the inflow area. Specifically, advantageous flow conditions and a short delay period may also be implemented with regard to the inflow area.

One advantageous implementation and a possible manufacture of the insert element are possible as described herein. Other embodiments of the insert element and/or other manufacturing processes for shaping the insert element are, however, also conceivable.

One advantageous embodiment of the base body is possible according to the refinement as described herein. Specifically, the base body may be manufactured in a casting process or with the aid of soldering. The base body and the insert element may be manufactured as two separate parts and subsequently assembled. During the assembly, the insert element is inserted into the base body. Subsequently, the base body may be closed with the aid of end pieces, for example. Depending on the application, the insert element may be fastened in the base body in a suitable manner, form-locked and/or integral connections being possible.

The damping area may be advantageously connected to the distribution area according to the refinement according to claim 9. For the purpose of decoupling, a throttled connection of the damping area to the distribution area may take place.

Exemplary embodiments of the present invention are explained in greater detail in the following description with reference to the appended drawings in which corresponding elements are provided with matching reference numerals.

DETAILED DESCRIPTION

Figure 1:
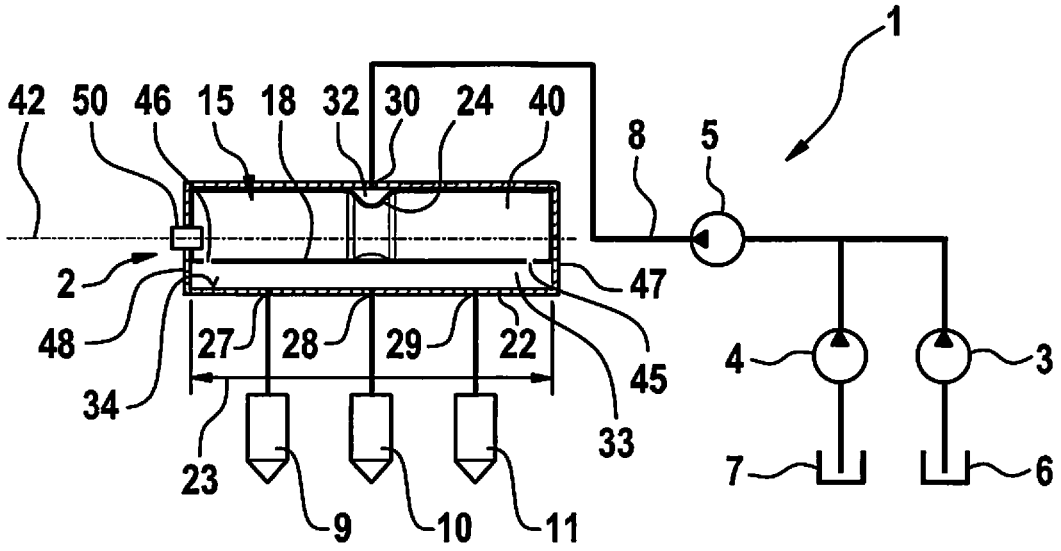
FIG. 1 shows a fuel injection system having a fuel distributor in a schematic illustration according to a first exemplary embodiment of the present invention.

FIG. 1 shows a fuel injection system 1 including a fuel distributor 2 in a schematic illustration according to a first exemplary embodiment, fuel distributor 2 being shown in a schematic, sectional illustration. In this exemplary embodiment, fuel injection system 1 includes a fuel pump 3 and a metering unit 4 which is configured as a backing pump 4. Furthermore, a high-pressure pump 5 is provided. Fuel pump 3 conveys liquid fuel from a tank 6 to high-pressure pump 5. Metering unit 4 is used to temporarily meter water from a reservoir 7 into the conveyed fuel. In this exemplary embodiment, the metering takes place upstream from high-pressure pump 5. In one modified embodiment, the metering may also take place at high-pressure pump 5. In a line section 8 provided between fuel distributor 2 and high-pressure pump 5, the liquid fuel or a mixture of the liquid fuel and water is conveyed depending on the operating state. Here, the water content in the mixture may be fixedly predefined or also vary over time depending on the embodiment.

Fuel distributor 2 is used to store and distribute fuel among fuel injectors 9, 10, 11 and thus reduces the pressure fluctuations or pulsations. Fuel distributor 2 may also be used to dampen pressure pulsations which may occur when fuel injectors 9 through 11 are switched. Fuel distributor 2 is configured in such a way that when metering unit 4 is switched on or off, for example, a short delay period is achieved with regard to adding the water upstream from high-pressure pump 5 and injecting the water via fuel injectors 9 through 11.

Figure 2:
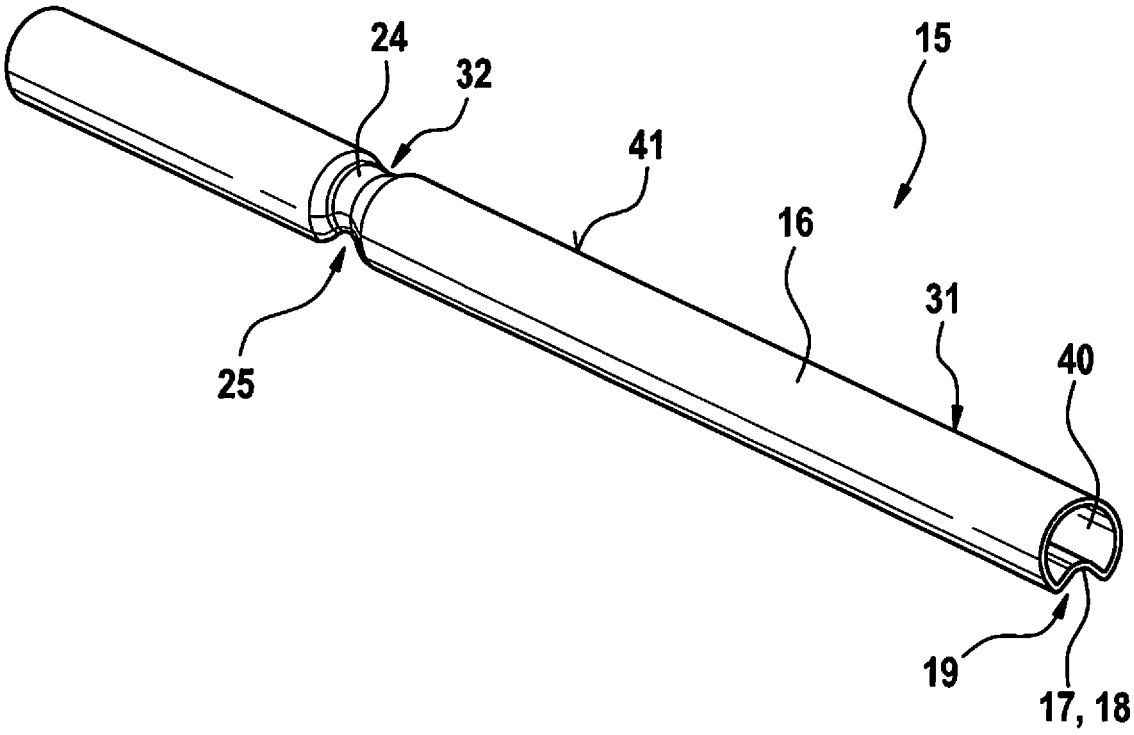
FIG. 2 shows an insert element for the fuel distributor shown in FIG. 1 in an excerpt from a schematic, spatial illustration.

FIG. 2 shows an insert element 15 for fuel distributor 2 shown in FIG. 1 in an excerpt from a schematic, spatial illustration. Here, insert element 15 may be based on a cylindrical jacket-shaped basic shape 16 which may be formed from a thin-walled sheet metal. In this exemplary embodiment, an indentation 17 of insert element 15, at which a thin-walled divider 18 is formed, is implemented starting from cylindrical jacket-shaped basic shape 16. Indentation 17 is provided at a side 19 of insert element 15. In particular, the entire cylindrical jacket-shaped basic shape 16 is predefined to be thin-walled.

Insert element 15 is situated in a base body 22 (FIG. 1) of fuel distributor 2. Indentation 17 may in particular extend along entire extension 23 of insert element 15 through base body 22. In one modified embodiment, indentation 17 may, however, also extend only across a part of extension 23 of insert element 15. Furthermore, insert element 15 has an inflow indentation 24. In this exemplary embodiment, inflow indentation 24 extends circumferentially about insert element 15. This results in an intersection 25 with indentation 17. High-pressure outputs 27 through 29 are provided in the area of side 19 of insert element 15 at base body 22 of fuel distributor 2. High-pressure outputs 27 through 29 lead to fuel injectors 9 through 11. A high-pressure input 30 is situated at another side 31 which faces away from side 19 of insert element 15 at base body 22. An inflow area 32 is formed by inflow indentation 24. Furthermore, a distribution area 33 is formed by indentation 17 between insert element 15 and an inner wall 34 of base body 22. In this exemplary embodiment, inflow area 32 leads on both sides into distribution area 33.

High-pressure input 30 is situated at base body 22 in such a way that high-pressure input 30 opens into inflow area 32. High-pressure outputs 27 through 29 directly open into distribution area 33. Thus, the fuel mixture having a variable composition is conveyed from line section 8 via high-pressure input 30 directly to inflow area 32 and from there directly into distribution area 33. In this case, the supplied fuel thus does not pass through damping area 40 which is provided within insert element 15 and, in particular, separated by divider 18. Since the cross sections of inflow area 32 and distribution area 33 may be small, a short time delay is made possible between the water being introduced into high-pressure pump 5 and the water leaving through fuel injectors 9 through 11 into assigned chambers, in particular combustion chambers.

Insert element 15 also has an outer side 41. Apart from inflow area 32 extending along inflow indentation 24 and distribution area 33 extending along indentation 17, outer side 41 of insert element 15 may rest at least essentially at inner wall 34 of base body 22. Divider 18 may be in this case essentially formed at indentation 17 of insert element 15. Insert element 15 may be based on a tubular basic shape 16, so that insert element 15 is at least essentially circumferentially closed. In this exemplary embodiment, inflow indentation 24 runs about a longitudinal axis 42 of insert element 15 or of fuel distributor 2. In one modified embodiment, fuel distributor 2 may, however, also have a bent configuration. Therefore, insert element 15 does not necessarily extend along a straight extension 23 of insert element 15. Inflow indentation 24 may also extend about a bent extension 23 of insert element 15. And indentation 17 may also extend about a bent extension 23 of insert element 15. And indentation 17 may also extend about a bent extension 23 of insert element 15 through the base body. Base body 22 may be configured as a tubular base body 22. However, other embodiments are also conceivable.

Figure 3:
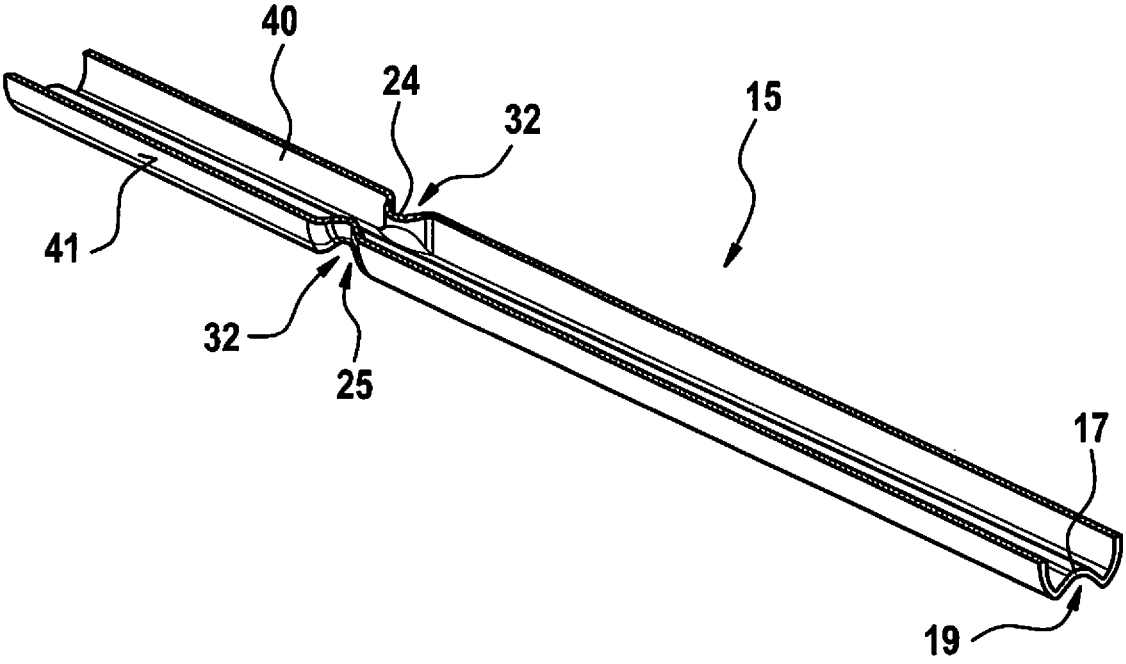
FIG. 3 shows an excerpt from a schematic, axial longitudinal section through the insert element shown in FIG. 2.

FIG. 3 shows insert element 15 in an excerpt of a schematic, axial longitudinal section along longitudinal axis 42. Viewed from inflow area 32, inflow indentation 24 is at least essentially concavely formed at insert element 15.

Figure 4:
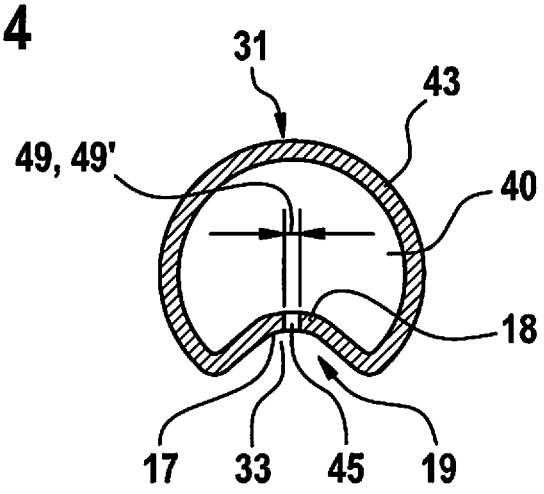
FIG. 4 shows an excerpt from a schematic sectional illustration of the insert element shown in FIG. 2 in an axial viewing direction.

FIG. 4 shows an excerpt of a schematic sectional illustration of insert element 15 in an axial viewing direction along longitudinal axis 42. Distribution area 33 is formed by indentation 17 at side 19 of insert element 15. Viewed from distribution area 33, indentation 17 is in this case at least essentially concavely formed at insert element 15. Apart from inflow area 32, profile 43 illustrated in FIG. 4 may be implemented in this case along longitudinal axis 42, at least essentially consistently. Insert element 15 may in this case be manufactured from a sheet metal in a rotary swaging process, for example. Here, indentation 17 and inflow indentation 24 may be formed in the process. In one modified embodiment, additional indentations may also be provided.

In one advantageous embodiment, at least one through-opening 45 which connects distribution area 33 to damping area 40 is provided at insert element 15. Through-opening 45 may be formed within or at the end of divider 18. If multiple through openings 45 are provided, they may be distributed along longitudinal axis 42 or along extension 23.

In one embodiment, through-opening 45 is provided in the area of an end 47 of base body 22 at insert element 15. One through-opening 46 which is configured correspondingly to through-opening 45 may be provided in the area of a further end 48 of base body 22 at insert element 15. Through openings 45, 46 may also be provided at the very ends 47, 48 at which a connection of insert element 15 to base body 22 is also possible.

A cross section 49, in particular diameter 49', of through-opening 45 may be selected in such a way that through-opening 45 is configured as a throttled through-opening 45. Through-opening 46 may be correspondingly configured as a throttled through-opening 46.

In this exemplary embodiment, a high-pressure sensor 50 is provided at end 48. In this exemplary embodiment, high-pressure sensor 50 is located at damping area 40. In one modified embodiment, high-pressure sensor 50 may also be located at distribution area 33.

A fuel injection system 1 may thus be implemented which makes possible an improved operating point with regard to a fuel consumption specifically in the case of high load. Specifically, a knocking tendency and high exhaust gas temperatures may be reduced by a water content. A reduction in the fuel consumption results with regard to a conventional measure for reducing the knocking tendency in which a late delay of the ignition is carried out. As a result of this late delay, the fuel consumption increases, while the performance demand remains the same. Furthermore, the fuel consumption increases when the mixture is enriched for the purpose of reducing the exhaust gas temperature. By metering water, which takes place at certain operating points, the knocking tendency is thus reduced in the case of a reduced high exhaust gas temperature. Since it is possible to increase or reduce the water content very rapidly, the result is an improved functionality. Here, an advantageous manufacture of fuel distributor 2 is possible.

The present invention is not limited to the described exemplary embodiments.

What is claimed is:

1. A fuel distributor for a mixture-compressing, spark-ignited internal combustion engine, comprising:

a base body at which at least one high-pressure input and multiple high-pressure outputs are provided; and at least one insert element which is situated in the base body, the at least one insert element separating a distribution area which connects the high-pressure outputs to one another at least essentially from a damping area;

wherein the at least one insert element is configured at least essentially as a reshaped insert element and the at least one insert element forms a divider which separates the distribution area at least essentially from the damping area, wherein the at least one insert element is at least essentially circumferentially closed.

2. The fuel distributor of claim 1, wherein at least one indentation is formed at the insert element and the distribution area extends along the indentation.

3. The fuel distributor of claim 1, wherein the divider is at least essentially at the indentation of the insert element.

4. The fuel distributor of claim 2, wherein in a profile which is oriented through the base body perpendicularly to a longitudinal axis or perpendicularly to an extension of the insert element, the indentation is at least essentially concavely formed at the insert element, viewed from the distribution area.

5. The fuel distributor of claim 1, wherein the insert element has a tubular basic shape and the insert element includes an inflow indentation which extends about a longitudinal axis or about an extension of the insert element through the base body and at which an inflow area is formed which is at least essentially separated from the damping area and which connects the high-pressure input to the distribution area.

6. The fuel distributor of claim 5, wherein in a longitudinal section viewed along the longitudinal axis or along the extension of the insert element through the base body, viewed from the inflow area, the inflow indentation is at least essentially concavely formed at the insert element.

7. The fuel distributor of claim 1, wherein the insert element is formed from a sheet metal and/or the insert element is formed at least essentially with the aid of a rotary swaging process.

8. The fuel distributor of claim 1, wherein the base body includes a tubular base body.

9. The fuel distributor of claim 1, wherein in the area of at least one end of the insert element, a through-opening is provided which connects the distribution area to the damping area; and/or at the divider of the insert element, at least one throttled through-opening is provided at which the distribution area is locally connected to the damping area; and/or the insert element extends along a longitudinal axis or along an extension of the insert element at least essentially from one end of the base body to another end of the base body.

10. The fuel distributor of claim 1, wherein the fuel distributor includes a fuel distribution rail.

11. A fuel injection system for injecting a fuel mixture having a variable composition, comprising:

a fuel distributor for a mixture-compressing, spark-ignited internal combustion engine, including:

a base body at which at least one high-pressure input and multiple high-pressure outputs are provided; and at least one insert element which is situated in the base body, the at least one insert element separating a distribution area which connects the high-pressure outputs to one another at least essentially from a damping area;

wherein the at least one insert element is configured at least essentially as a reshaped insert element and the at least one insert element forms a divider which separates the distribution area at least essentially from the damping area, wherein the at least one insert element is at least essentially circumferentially closed.

* * * * *